US011273338B2

(12) United States Patent
Chen

(10) Patent No.: US 11,273,338 B2
(45) Date of Patent: Mar. 15, 2022

(54) DUMBBELL AND BARBELL SUPPORTING SYSTEM

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 23 days.

(21) Appl. No.: 16/853,859

(22) Filed: Apr. 21, 2020

(65) Prior Publication Data

US 2021/0322815 A1 Oct. 21, 2021

(51) Int. Cl.
*A63B 21/078* (2006.01)
*A63B 21/072* (2006.01)
*A63B 21/075* (2006.01)

(52) U.S. Cl.
CPC ..... *A63B 21/078* (2013.01); *A63B 21/075* (2013.01); *A63B 21/0724* (2013.01); *A63B 21/0726* (2013.01); *A63B 21/0728* (2013.01)

(58) Field of Classification Search
CPC ..... A63B 21/00047; A63B 21/072; A63B 21/0722; A63B 21/0274; A63B 21/0726; A63B 21/0728; A63B 21/075; A63B 21/078; A63B 2225/10
See application file for complete search history.

(56) References Cited

U.S. PATENT DOCUMENTS

| | | | | |
|---|---|---|---|---|
| 5,472,397 | A * | 12/1995 | Ammoscato | A63B 21/078 482/104 |
| 6,592,499 | B2 * | 7/2003 | Parker | A63B 21/072 482/106 |
| 7,001,314 | B1 * | 2/2006 | Hummer, Jr. | A63B 21/00181 482/104 |
| 7,022,053 | B2 | 4/2006 | Whetstone | |
| 7,094,185 | B2 * | 8/2006 | Greenland | A63B 21/06 482/100 |
| 7,201,711 | B2 | 4/2007 | Towley, III et al. | |
| 7,491,156 | B1 | 2/2009 | GaoYong | |
| 8,047,971 | B2 | 11/2011 | Parker | |
| 8,444,537 | B1 | 5/2013 | Santoro | |
| 8,992,395 | B2 | 3/2015 | Orakwusi | |
| 9,717,943 | B2 | 8/2017 | Klonoski | |
| 9,956,451 | B1 | 5/2018 | Wang | |
| 10,328,299 | B2 | 6/2019 | Wang | |

(Continued)

*Primary Examiner* — Megan Anderson
*Assistant Examiner* — Kathleen M Fisk
(74) *Attorney, Agent, or Firm* — Browdy and Neimark, PLLC

(57) ABSTRACT

A dumbbell and barbell supporting system includes two tables rotatably attached to a base and rotatable relative to the base to two working positions where the tables are inclined relative to each other or are in line with each other, and two dumbbells disposed on the tables, the dumbbells each include two or more weight members or two weight elements, and a handlebar engageable with the weight members and the weight elements for detachably coupling the weight members and the weight elements to the handlebar, the tables are rotatable to be in lined with each other, and a longitudinal bar engageable with the weight members and the weight elements for forming a barbell exerciser device.

16 Claims, 14 Drawing Sheets

(56) References Cited

U.S. PATENT DOCUMENTS

2003/0134723 A1* 7/2003 Greenland ..... A63B 21/078 482/104
2004/0162197 A1* 8/2004 Towley, III ..... A63B 21/0605 482/107
2004/0220024 A1* 11/2004 Krull ..... A63B 71/0036 482/94
2004/0259696 A1* 12/2004 Shifferaw ..... A63B 21/4047 482/94
2005/0003937 A1* 1/2005 Chen ..... A63B 71/0036 482/104
2005/0054494 A1* 3/2005 Guerrettaz ..... A63B 71/0036 482/97
2007/0082795 A1* 4/2007 Murray ..... A63B 21/078 482/104
2009/0192027 A1* 7/2009 Parker ..... A63B 21/0722 482/108
2009/0305851 A1* 12/2009 Sukup ..... A63B 21/078 482/104
2011/0177922 A1* 7/2011 Selinger ..... A63B 21/0724 482/107
2012/0021877 A1* 1/2012 Lundquist ..... A63B 21/075 482/107
2013/0324375 A1* 12/2013 Svenberg ..... A63B 21/0728 482/108
2014/0121073 A1* 5/2014 Hardy ..... A63B 21/078 482/104
2014/0128229 A1* 5/2014 York ..... A63B 21/078 482/104
2018/0064984 A1* 3/2018 Adrillon ..... A63B 21/4045
2018/0178051 A1* 6/2018 Shaw, Jr. ..... A63B 21/4029
2020/0261759 A1* 8/2020 Downing ..... A63B 21/0726
2020/0306578 A1* 10/2020 Pohl ..... A63B 21/0724
2020/0346063 A1* 11/2020 Shaw, Jr. ..... A63B 21/0726
2021/0146187 A1* 5/2021 Chen ..... A63B 21/0728

* cited by examiner

DUMBBELL AND BARBELL SUPPORTING SYSTEM

BACKGROUND OF THE INVENTION

1. Field of the Invention

The present invention relates to an exercise device supporting system, and more particularly to a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

2. Description of the Prior Art

Various kinds of typical adjustable exercise devices, such as dumbbells have been developed and provided for conducting various exercise operations, and various kinds of typical supporting devices have been developed and provided for supporting various exercise devices, such as the adjustable dumbbells, the barbell devices or the like.

For example, U.S. Pat. No. 7,022,053 B2 to Whetstone, U.S. Pat. No. 7,201,711 B2 to Towley, III et al., U.S. Pat. No. 7,491,156 to GaoYong, U.S. Pat. No. 8,047,971 B2 to Parker, U.S. Pat. No. 8,444,537 B1 to Santoro, U.S. Pat. No. 8,992,395 to Orakwusi, U.S. Pat. No. 9,717,943 B2 to Klonoski, U.S. Pat. No. 9,956,451 B1 to Wang, and U.S. Pat. No. 10,328,299 B2 to Wang disclose several of the typical exercise device supporting structures or configurations for supporting adjustable dumbbell devices or the like.

However, the typical exercise device supporting structures or configurations may only be provided for supporting the dumbbell devices, but failed to teach and provide an exercise device supporting system for supporting one or more dumbbell devices and for allowing the dumbbell devices to be easily and quickly adjusted or converted to a barbell device.

The present invention has arisen to mitigate and/or obviate the afore-described disadvantages of the conventional exercise device supporting structures.

SUMMARY OF THE INVENTION

The primary objective of the present invention is to provide a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

In accordance with one aspect of the invention, there is provided a dumbbell and barbell supporting system comprising a base, a first table and a second table rotatably attached to the base, the first and the second tables being rotatable relative to the base to a first working position where the first and the second tables are inclined relative to each other, and a second working position where the first and the second tables are in line with each other, a first dumbbell disposed on the first table, the first dumbbell including a first weight member and a second weight member, and a first handlebar engageable with the first weight member and the second weight member for detachably coupling the first weight member and the second weight member to the first handlebar, a second dumbbell disposed on the second table, the second dumbbell including a first weight element and a second weight element, and a second handlebar engageable with the first weight element and the second weight element for detachably coupling the first weight element and the second weight element to the second handlebar, two carriers provided for engaging with and for supporting the first weight member and the first weight element, two brackets provided for engaging with and for supporting the second weight member and the second weight element, the carriers and the first weight member and the first weight element being rotatable and movable toward the brackets and the second weight member and the second weight element when the first and the second tables are positioned in the second working position, and a longitudinal bar engageable with the first weight member and the first weight element for detachably coupling the first weight member and the second weight member and the first weight element and the second weight element to the longitudinal bar.

The first and the second tables each include a pivot spindle engaged with the base for allowing the first and the second tables to be rotated relative to the base. The first and the second tables each include a groove, and the carriers each include an axle slidably engaged with the groove of the table and for guiding the carrier to slide relative to the table.

The first and the second tables each include a follower, and the axle is attached to the follower. The base includes two ears, and the ears each include a channel formed in the ear, and the follower each include a roller engaged with the channel of the ear for guiding and moving the follower to slide relative to the table. The first and the second tables each include a rack, and a gear is attached to each of the carriers and meshed with the rack for allowing the gear and the carrier to be rotated relative to the table when the carriers are moved relative to the tables.

The first and the second tables each include a housing, the brackets are slidably engaged with the housings respectively. The first and the second tables each include a spring biasing member engaged with the bracket for biasing and forcing the bracket to move upwardly relative to the housing. The brackets each include a lock for engaging with the housing. The base includes two stands, and the tables each include a roller engaged with the stand for supporting and carrying the tables on the base.

The first dumbbell includes two spring biased catches slidably engaged in the first handlebar and engageable with the first and the second weight members for coupling the first and the second weight members to the first handlebar. The first and the second weight members each include a dovetail slot formed in one side, and a dovetail on another side, and the first handlebar includes two end plates, and each end plate include a dovetail slot for engaging with the dovetails of the first and the second weight members.

The second dumbbell includes two spring biased catches slidably engaged in the second handlebar and engageable with the first and the second weight elements for coupling the first and the second weight elements to the second handlebar. The first and the second weight elements each include a dovetail slot formed in one side, and a dovetail on another side, and the second handlebar includes two end plates, and each end plate include a dovetail slot for engaging with the dovetails of the first and the second weight elements.

The longitudinal bar includes two end panels, and each end panel include a dovetail slot for engaging with the dovetails of the first weight member and the first weight element. The longitudinal bar includes two spring biased locks for engaging with the first and the second weight members and the first and the second weight elements.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
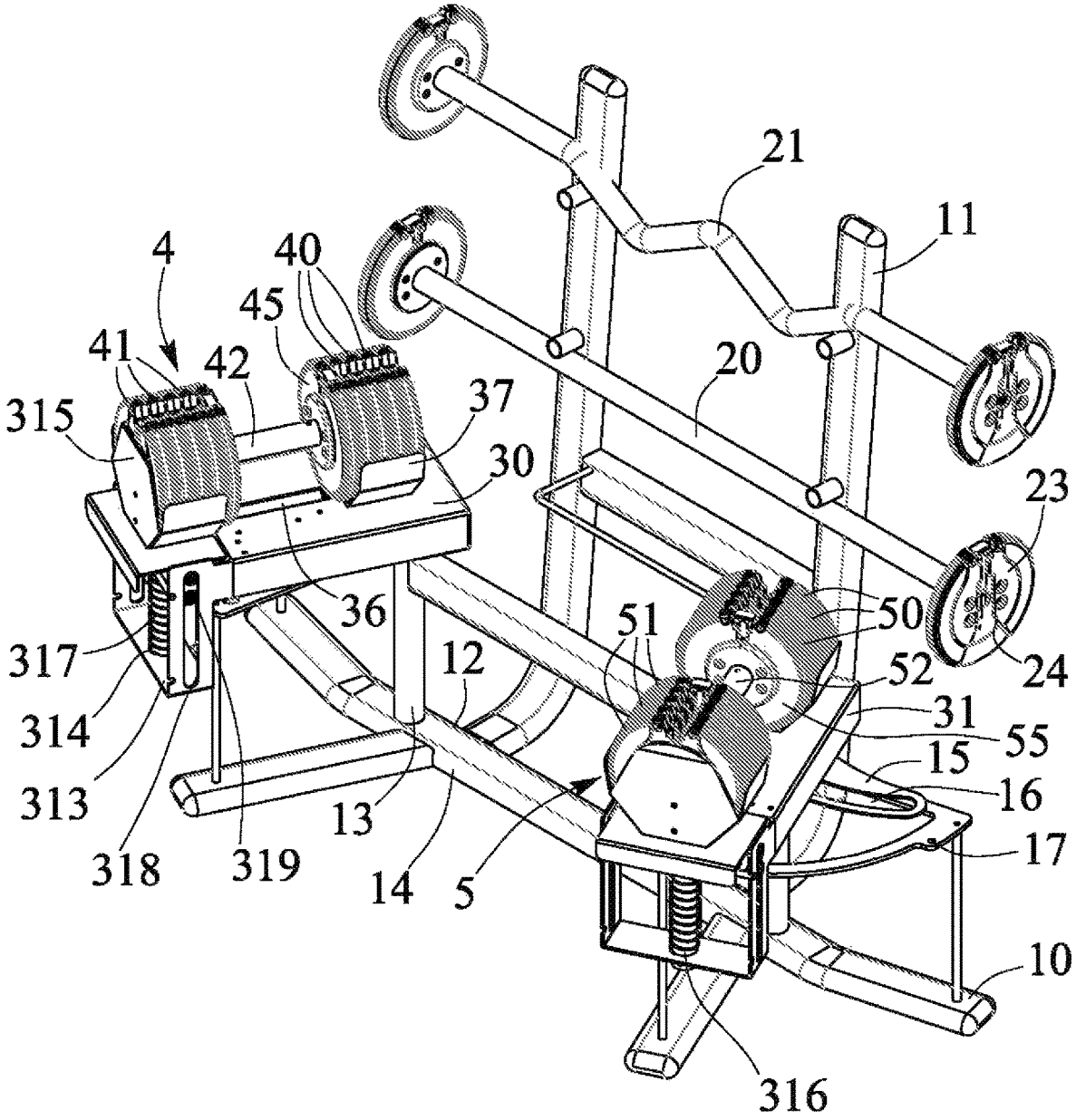
FIG. 1 is an upper perspective view of a dumbbell and barbell supporting system in accordance with the present invention as seen from the front portion of the dumbbell and barbell supporting system.

Referring to the drawings, and initially to FIGS. 1-9, a dumbbell and barbell supporting system in accordance with the present invention comprises a supporting base 10, a bracket or stand or frame 11 extended upwardly from the base 10, such as extended upwardly from the rear portion 12 of the base 10 for supporting one or more elongated or longitudinal bars 20, 21 (FIGS. 1-4) and/or one or more weight devices or rings or plates or elements or weight members (not illustrated) thereon. The base 10 may further include one or more (such as two) columns or posts 13 extended upwardly therefrom, such as extended upwardly from the rear or middle or intermediate portion 14 of the base 10, and two guide plates or ears 15 (FIGS. 7-8 and 13-14) attached or mounted or secured to or formed or provided on the posts 13 respectively, and the ears 15 each include an oblong hole or guide groove or guide channel 16 formed therein.

One or more (such as two) supporting plates or tables 30, 31 are pivotally or rotatably attached or mounted or secured to the base 10, for example, the first and the second tables 30, 31 each include a pivot axle or shaft or spindle 32 (FIGS. 7-8 and 13-14) extended downwardly therefrom and engaged with the posts 13 of the base 10 respectively for allowing the tables 30, 31 to be pivoted or rotated relative to the base 10 between a first or tilted or inclined working position (FIGS. 1-2 and 5-6) where the tables 30, 31 are tilted or inclined relative to each other, and a second or aligned working position (FIGS. 3-4 and 9-11) where the tables 30, 31 are in line or aligned with each other. The tables 30, 31 each include one or more (such as two) slides or rails 33 provided or disposed in the lower or bottom portion thereof (FIGS. 6, 8-9 and 11), and a slide or follower 34 is slidably attached or mounted or engaged with the rails 33 for allowing the follower 34 to be slid or moved relative to the tables 30, 31 and along the rails 33.

Figure 6:
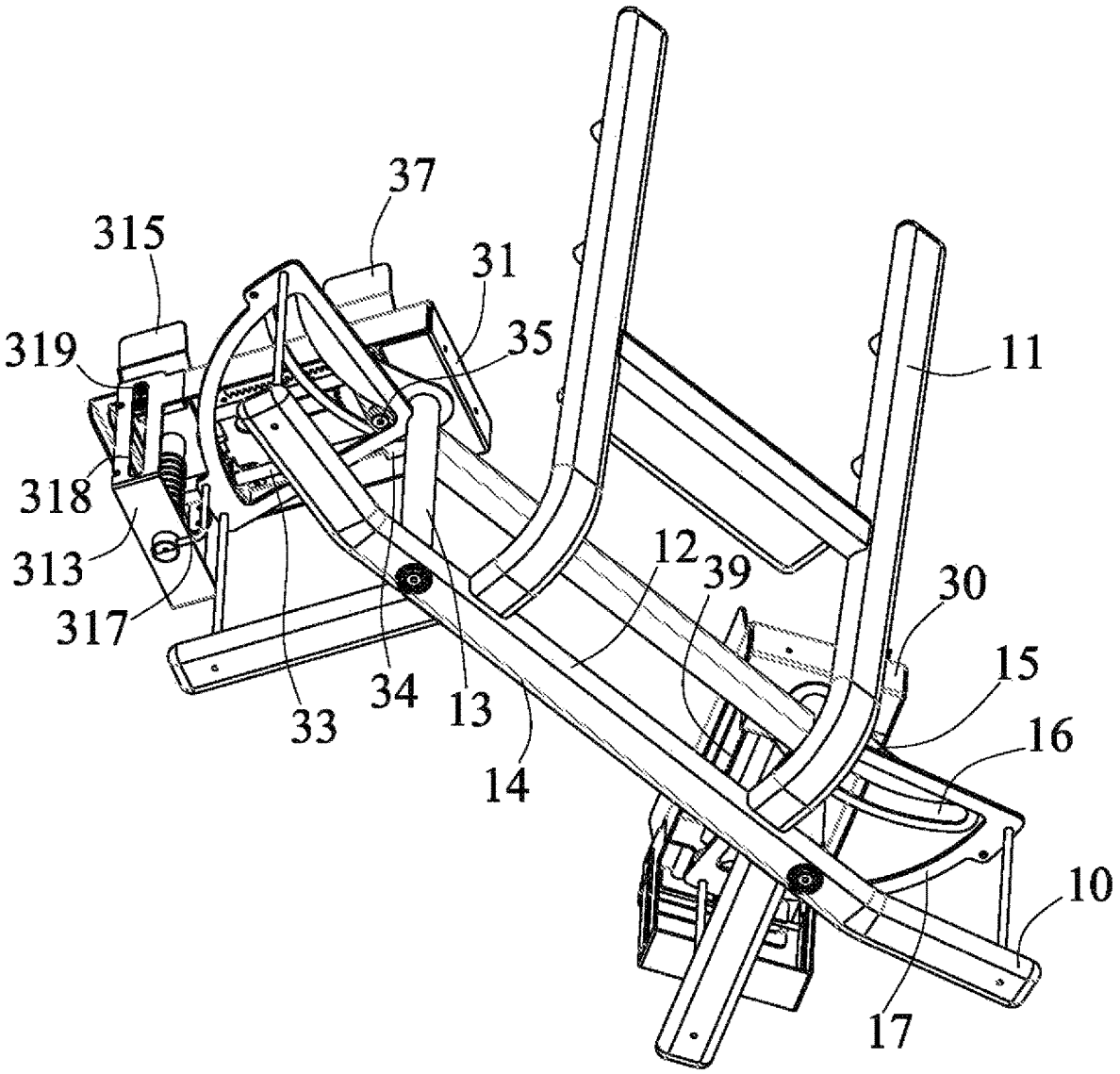
FIG. 6 is a bottom upper perspective view of the dumbbell and barbell supporting system as shown in FIG. 5.
Figure 9:
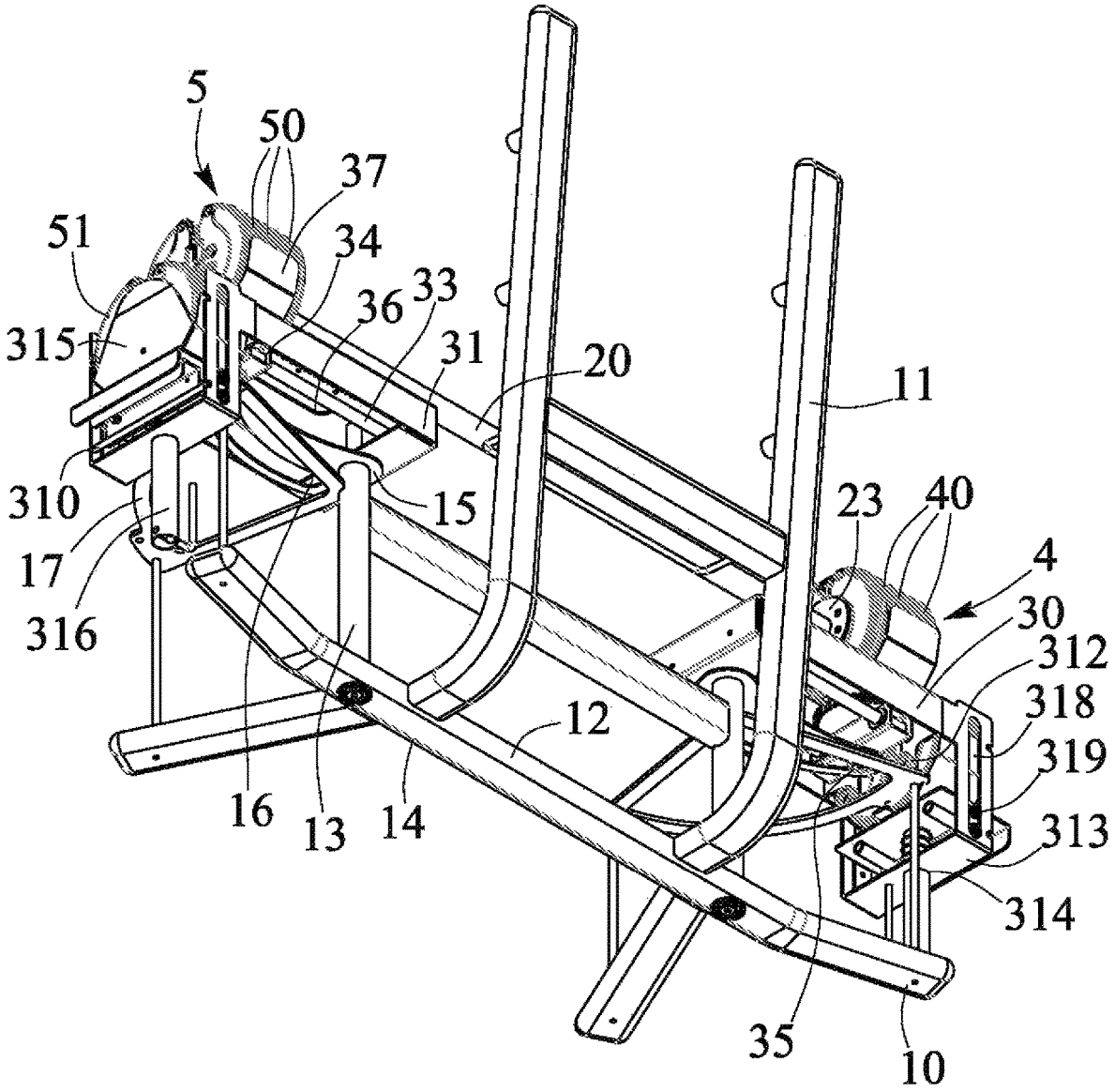
FIG. 9 is a still further upper perspective view similar to FIG. 6, with the dumbbell devices supported thereon.
Figure 10:
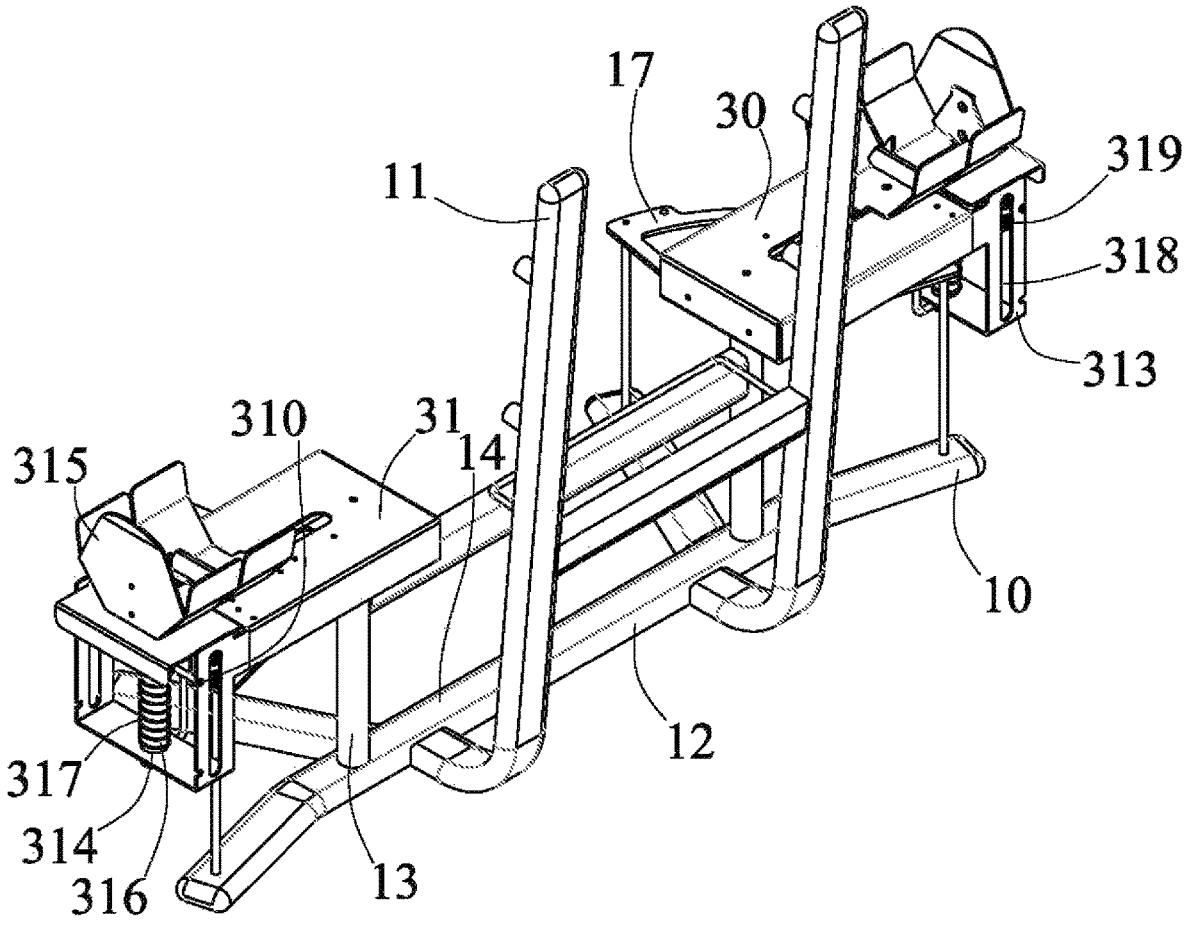
FIG. 10 is a still further upper perspective view similar to FIG. 5, illustrating the operation of the dumbbell and barbell supporting system.
Figure 11:
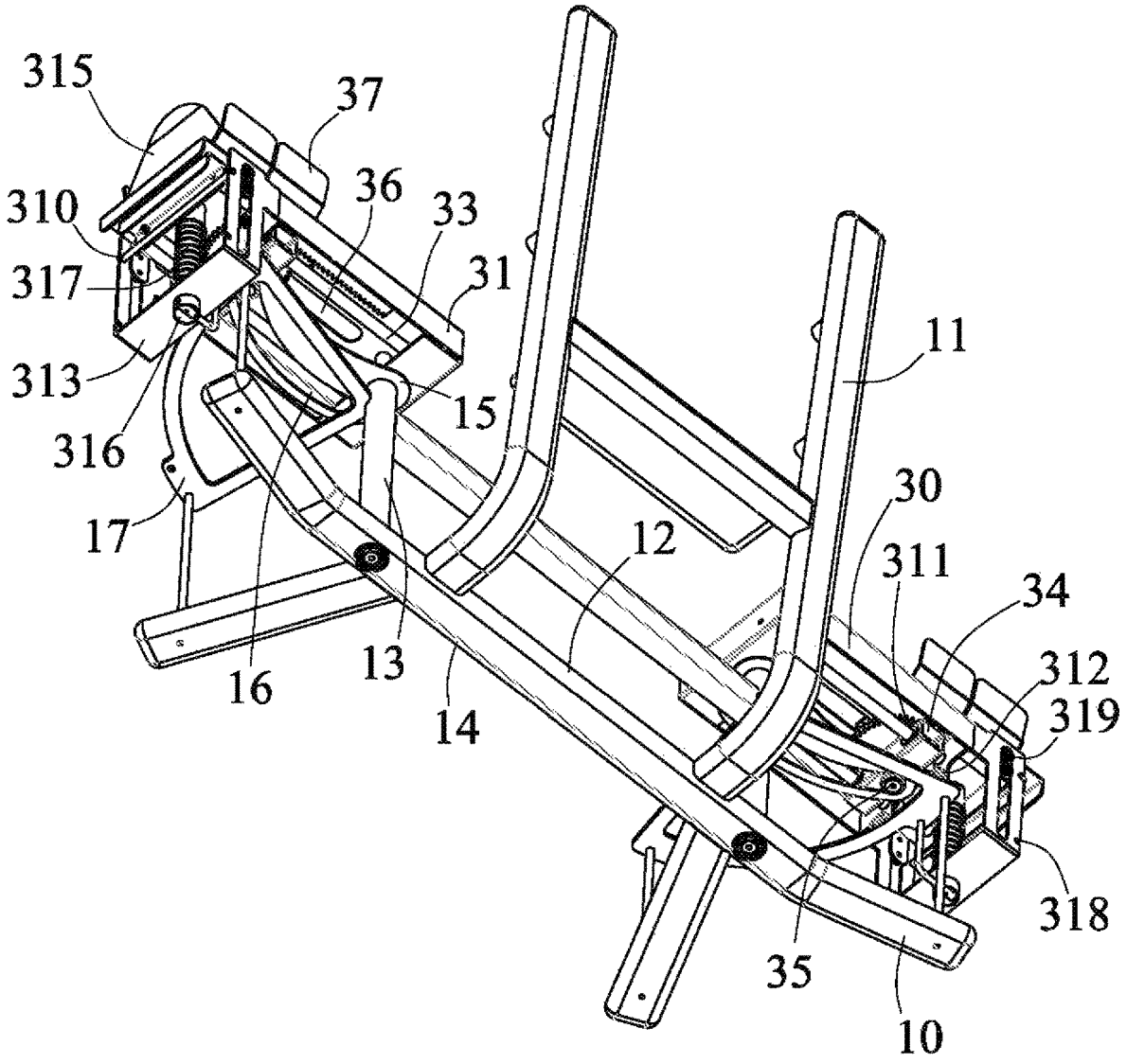
FIG. 11 is a still further upper perspective view similar to FIG. 9, with the dumbbell devices removed.
Figure 12:
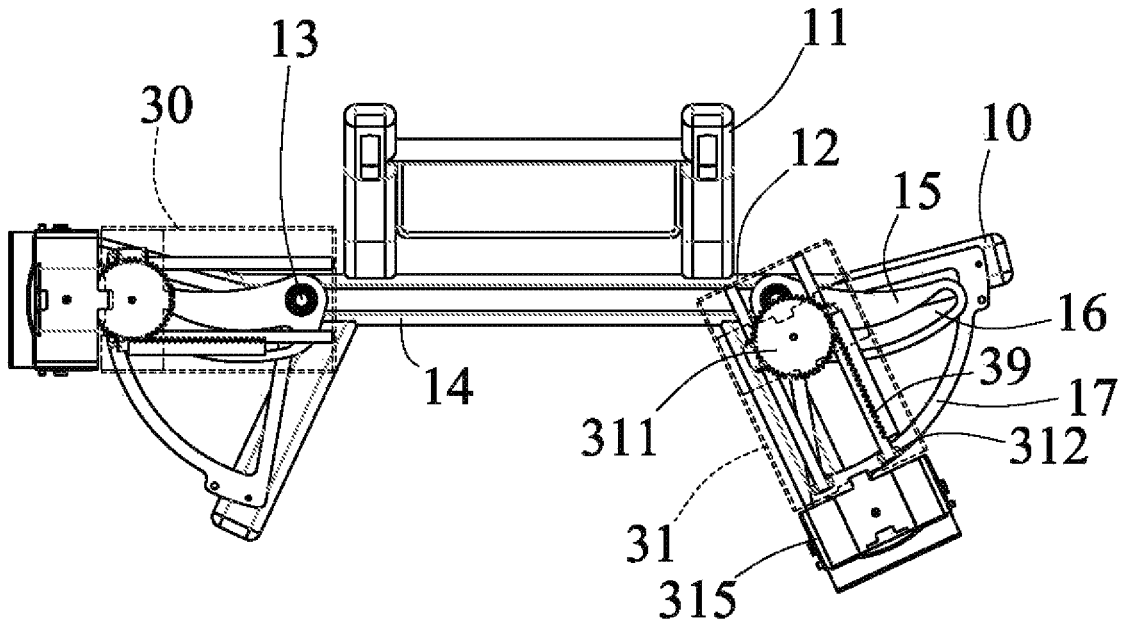
FIG. 12 is a top plan schematic view illustrating the operation of the dumbbell and barbell supporting system.
Figure 13:
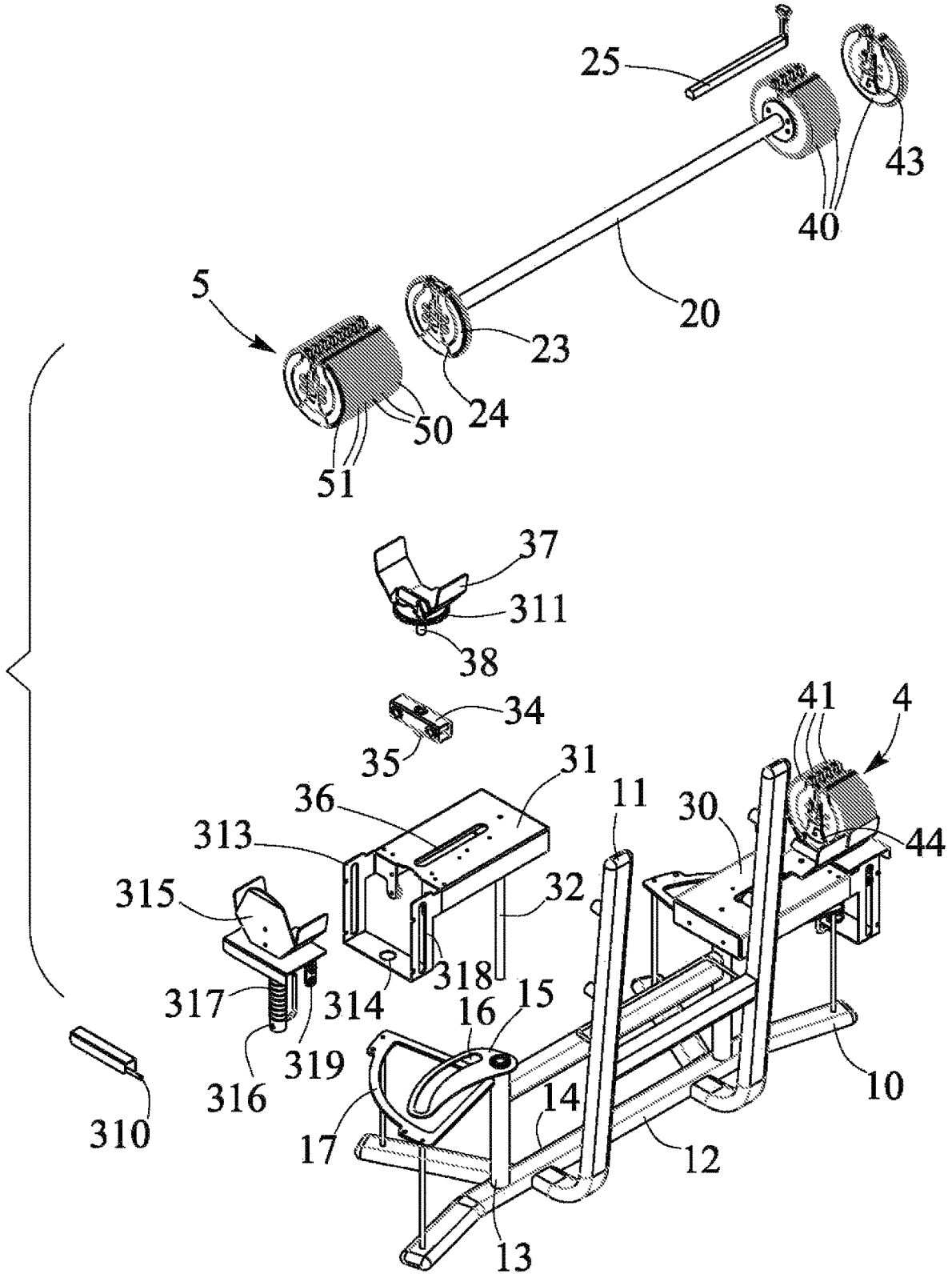
FIGS. 13 and 14 are other partial exploded views illustrating the operation of the dumbbell and barbell supporting system.
Figure 14:
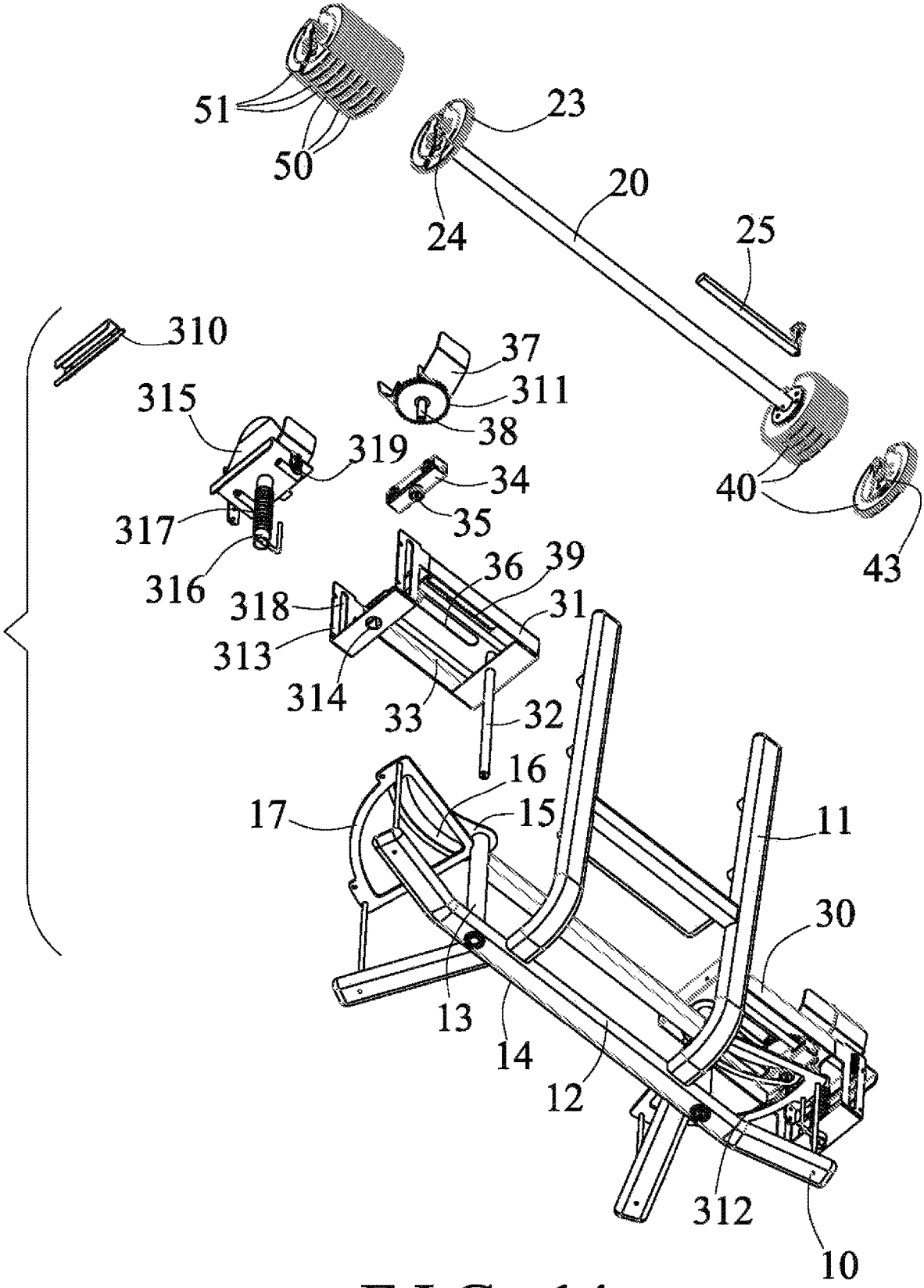

As shown in FIGS. 6, 9 and 11, the followers 34 each include a wheel or roller 35 formed or provided thereon and engaged with the guide channels 16 of the ears 15 respectively for guiding and moving the follower 34 to slide or move along the rails 33 when the table 30, 31 is pivoted or rotated relative to the base 10 between the tilted working position and the aligned working position. The tables 30, 31 each include an oblong hole or guide channel or guide groove 36 formed therein. Two trays or carriers 37 are pivotally or rotatably attached or mounted or secured to the followers 34 respectively with a pivot shaft or spindle or axle 38 for allowing the follower 34 together with the carrier 37 to be slid or moved relative to the tables 30, 31. The axle 38 of the carrier 37 is slidably engaged with the groove 36 of the table 30, 31 for allowing the carrier 37 to be guided to slide or move relative to the table 30, 31 together with the follower 34. The tables 30, 31 each include a track or rack 39 formed or provided therein.

A gear wheel or gear 311 is attached or mounted or secured to the carrier 37 and meshed or engaged with the rack 39 of the table 30, 31 for allowing the gear 311 and thus the carrier 37 to be pivoted or rotated relative to the table 30, 31 when the carrier 37 and the follower 34 are moved relative to the table 30, 31. In operation, when the table 30, 31 is pivoted or rotated relative to the base 10 between the tilted working position and the aligned working position, the follower 34 will be forced to slide or move along the rails 33 and relative to the table 30, 31, and the gear 311 and the carrier 37 will then be forced to pivot or rotate relative to the table 30, 31. It is preferable, but not necessary that the base 10 may further include one or more (such as two) curved frames or brackets or stands 17 formed or provided thereon, and the tables 30, 31 each include one or more (such as two) wheels or rollers 312 formed or provided thereon (FIGS. 8-9 and 11-12) for engaging with the stands 17 and for solidly and stably and slidably supporting and carrying the tables 30, 31 on the base 10.

The tables 30, 31 each further include a frame or bracket or housing 313 formed or provided thereon which includes an orifice 314 formed therein (FIGS. 7-8), and a bracket 315 includes a pivot axle or spindle or shaft 316 slidably engaged through the orifice 314 of the housing 313 for allowing the bracket 315 to be moved up and down relative to the housing 313, and a spring biasing member 317 is engaged onto the shaft 316 and engaged between the bracket 315 and the housing 313 for biasing and forcing or moving the bracket 315 upwardly relative to the housing 313. The housing 313 further includes one or more (such as two) grooves or passages 318 formed therein, and the bracket 315 further includes one or more wheels or pulleys or rollers 319 engaged in the passages 318 of the housing 313 for solidly and stably guiding and limiting the bracket 315 to move up and down relative to the housing 313.

Two dumbbell exercise devices, such as a first and a second adjustable dumbbells 4, 5 are detachably or changeably or removably provided or disposed or supported on the tables 30, 31 respectively, and the carriers 37 and the brackets 315 may be provided for engaging with and for supporting the first and the second dumbbells 4, 5 on the tables 30, 31 respectively. For example, the first dumbbell 4 includes two sets of weight rings or plates or members 40, 41, and the second dumbbell 5 includes two sets of weight rings or plates or elements 50, 51, and the dumbbells 4, 5 each include a first or a second handlebar 42, 52 to be disposed or engaged between or with the weight members 40, 41 and the weight elements 50, 51 for forming or acting as the dumbbells 4, 5. The above-described structure or configuration for the dumbbells 4, 5 is typical and will not be described in specific details. The carriers 37 and the brackets 315 are provided for engaging with and for supporting the sets of weight members 40, 41 and the weight elements 50, 51 of the dumbbells 4, 5 respectively. The structure of the dumbbells 4, 5 may be identical to each other.

Figure 2:
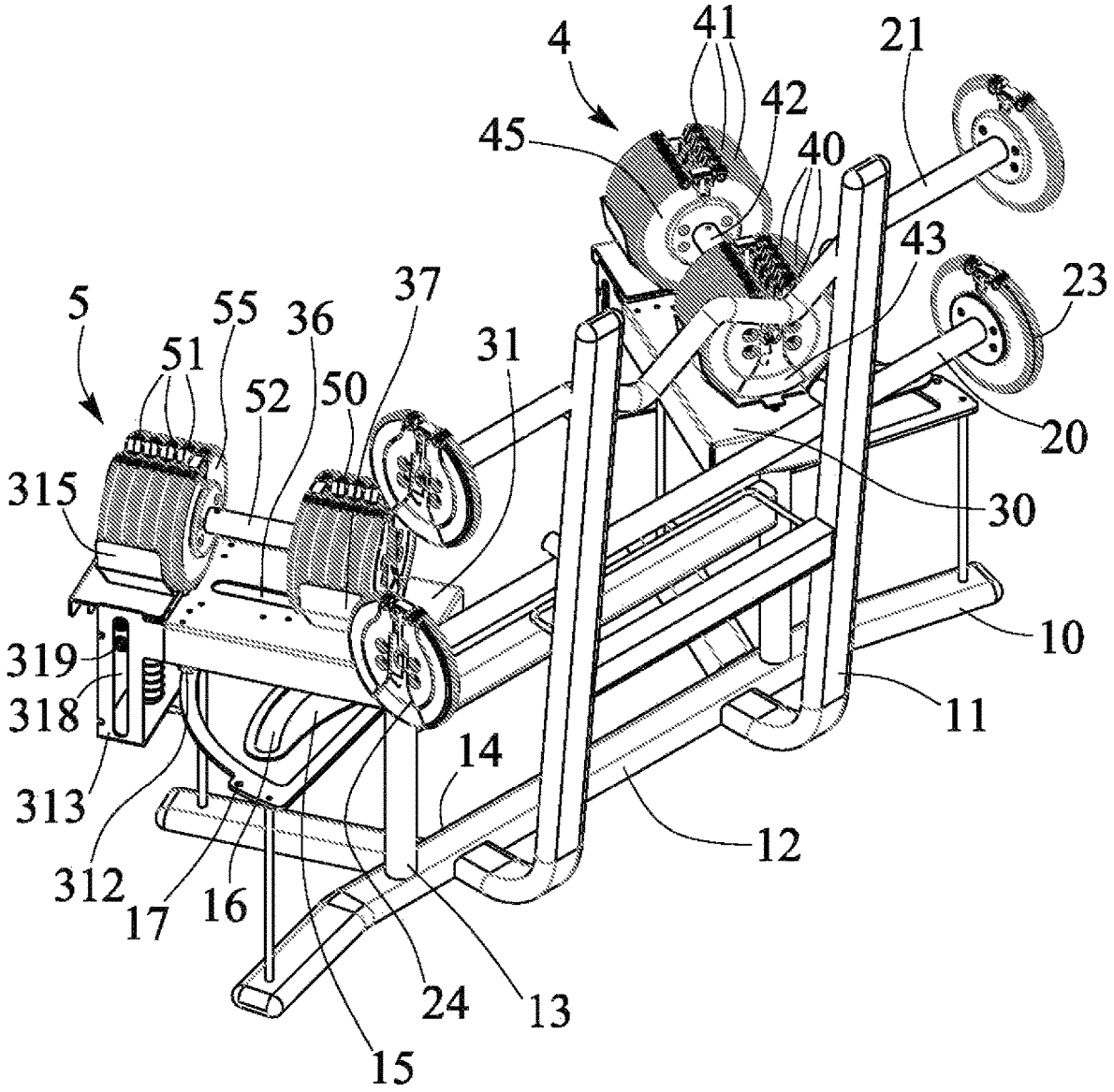
FIG. 2 is another upper perspective view of the dumbbell and barbell supporting system as seen from the rear portion of the dumbbell and barbell supporting system.

In operation, as shown in FIGS. 1-2, the dumbbells 4, 5 are disposed or supported on the tables 30, 31 which are tilted or inclined relative to each other and arranged for allowing the handlebars 42, 52 of the dumbbells 4, 5 to be easily and quickly held or grasped and actuated or operated by the users selectively. For example, the carriers 37 may be provided for engaging with and for supporting the first set or the first weight members 40 and the first set or the first weight elements 50 of the dumbbells 4, 5 respectively, and the brackets 315 may be provided for engaging with and for supporting the second set or the second weight members 41 and the second set or the second weight elements 51 of the dumbbells 4, 5 respectively, As shown in FIGS. 7-8, the first set or the first weight members 40 and the second set or the second weight members 41 each include a dovetail slot 43 formed in one side portion thereof and a dovetail 44 (FIG. 13) on the other side portion thereof for engaging with the dovetail slot 43 of the other weight members 40, 41 and for allowing the weight members 40, 41 to be engaged with each other in order to form the first and the second sets of the weight members 40, 41 respectively.

Figure 7:
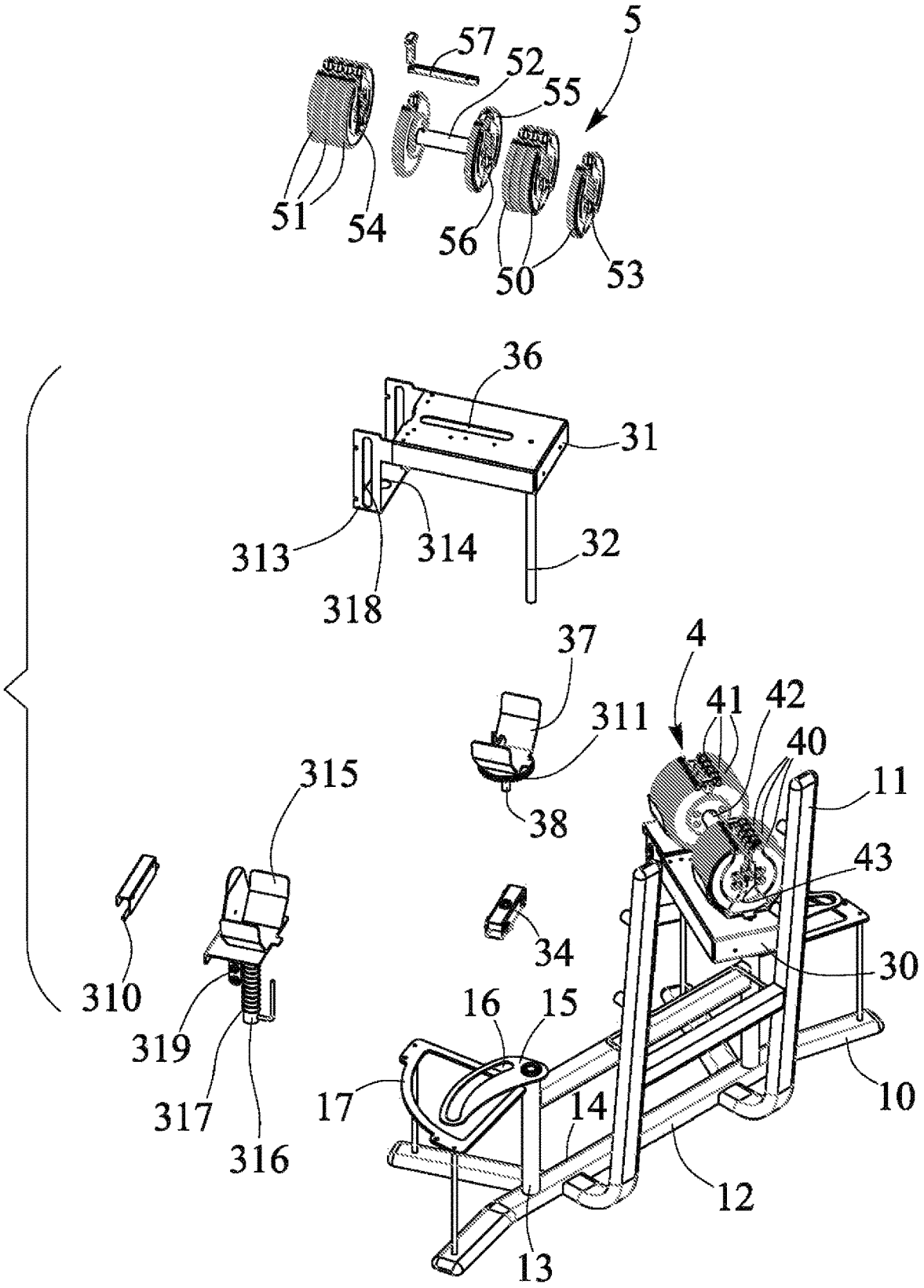
FIGS. 7, 8 are partial exploded views of the dumbbell and barbell supporting system.
Figure 8:
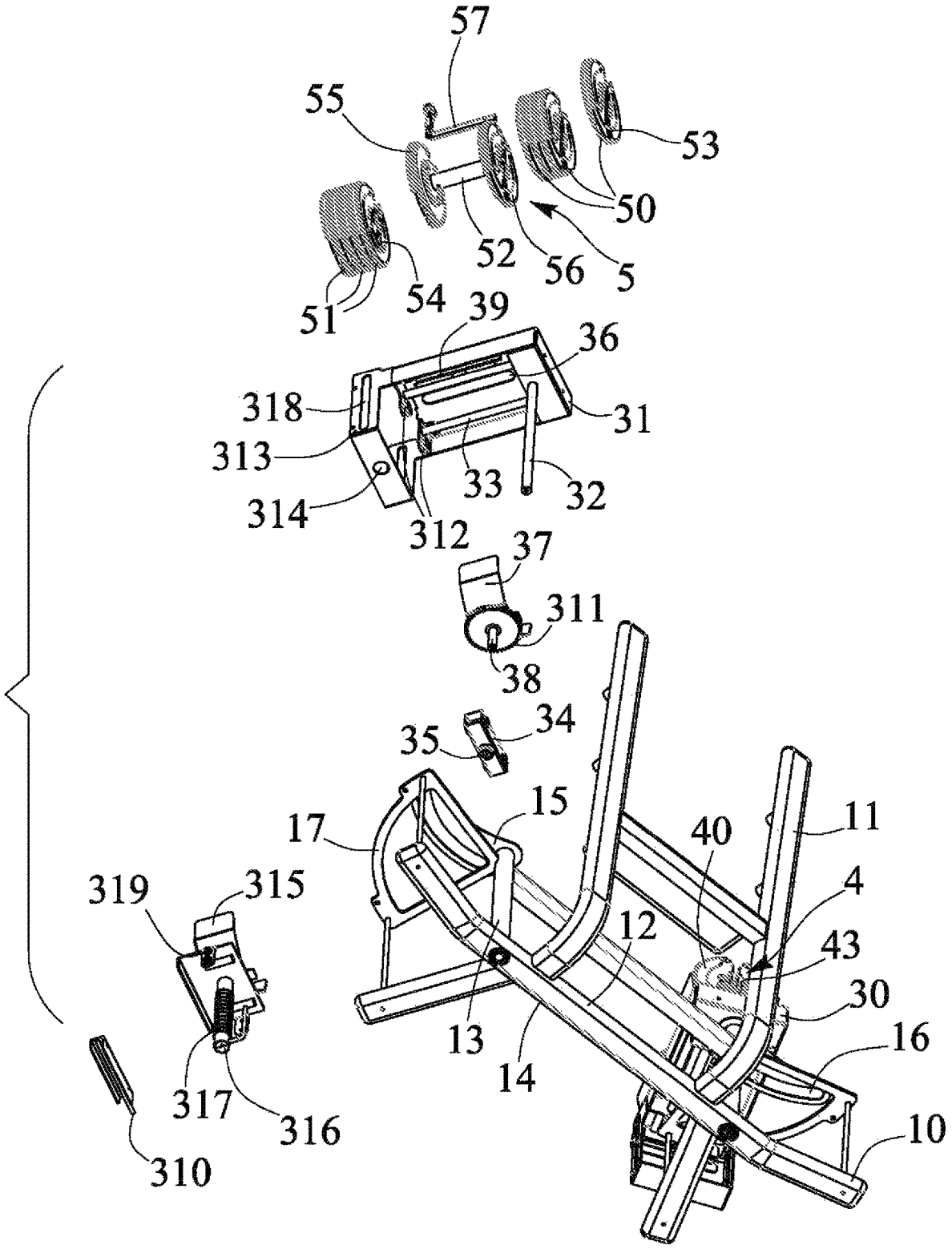

Similarly, as also shown in FIGS. 7-8, the first set or the first weight elements 50 and the second set or the second weight elements 51 each include a dovetail slot 53 formed in one side portion thereof, and a dovetail 54 on the other side portion thereof for engaging with the dovetail slot 53 of the other weight elements 50, 51 and for allowing the weight elements 50, 51 to be engaged with each other in order to form the first and the second sets of the weight elements 50, 51 respectively, and the dovetails 54 of the two sets of the weight elements 50, 51 are disposed and located or faced or directed toward each other, and the dovetails 44 of the two sets of the weight members 40, 41 are also disposed and located or faced or directed toward each other. The handlebars 42, 52 of the dumbbells 4, 5 each include two end plates 45, 55, and each end plate 45, 55 include another dovetail slot 46 (FIGS. 3-4), 56 (FIGS. 7-8) formed therein for engaging with the dovetails 44, 54 of the weight members 40, 41 and the weight elements 50, 51 respectively, and for allowing the weight members 40, 41 and the weight elements 50, 51 to be attached or coupled to the handlebars 42, 52 respectively.

The dumbbells 4, 5 each further include one or more (such as two) spring biased latch or catch 57 (FIGS. 7-8) slidably received or engaged in the handlebars 42, 52 respectively and engageable with the weight members 40, 41 and the weight elements 50, 51 for allowing the selective number of the weight members 40, 41 and the weight elements 50, 51 to be attached or coupled to the handlebars 42, 52 respectively. It is to be noted that the dovetails 44 of the two sets of the weight members 40, 41 are normally disposed and directed toward each other, and the dovetails 54 of the two sets of the weight elements 50, 51 are also disposed and directed toward each other for allowing the dovetail slots 46, 56 of the end plates 45, 55 of the handlebars 42, 52 to be engaged with the dovetails 44, 54 of the weight members 40, 41 and the weight elements 50, 51 selectively.

When it is required to be acted or operated as a barbell exerciser, the handlebars 42, 52 are required to be removed or disengaged from the weight members 40, 41 and the weight elements 50, 51 respectively, and attached or mounted or secured to the frame 11 (FIGS. 3-4), and as shown in FIGS. 3-4 and 9-14, the tables 30, 31 may then be pivoted or rotated relative to the base 10 to a position where the tables 30, 31 are aligned with each other. When the tables 30, 31 are pivoted or rotated relative to the base 10 from the tilted working position (FIGS. 1-2), in which they are angled relative to each other in a horizontal plane, to the aligned working position (FIGS. 3-4), the carriers 37 and the first set or the first weight members 40 and the first set or the first weight elements 50 of the dumbbells 4, 5 will then be forced to pivot or rotate relative to the table 30, 31 for so that they are about one hundred and eighty (180) degrees from one another, and the dovetail slots 43, 53 of the first set or the first weight members 40 and the first weight elements 50 of the dumbbells 4, 5 will be rotated and directed toward the dovetails 44, 54 of the second weight members 41 and the second weight elements 51.

Before the carriers 37 and the first weight members 40 and the first weight elements 50 are rotated to one hundred and eighty (180) degrees, the brackets 315 and the second set or the second weight members 41 and the second weight elements 51 of the dumbbells 4, 5 may be depressed downwardly for allowing the dovetails 44, 54 of the second weight members 41 and the second weight elements 51 to be engaged with the dovetail slots 43, 53 of the first set or the first weight members 40 and the first weight elements 50 when the carriers 37 and the first weight members 40 and the first weight elements 50 have been rotated to one hundred and eighty (180) degrees. As shown in FIGS. 7-9, the bracket 315 may further include a catch or latch or lock 310 for engaging with the housing 313 and for retaining the bracket 315 and thus the second set or the second weight members 41 and the second weight elements 51 at the downwardly depressed position (FIG. 9) and thus for allowing the dovetails 44, 54 of the second weight members 41 and the second weight elements 51 to be suitably engaged with the dovetail slots 43, 53 of the first set or the first weight members 40 and the first weight elements 50.

The longitudinal bars 20, 21 each also include two end plates or panels 23, and each end panel 23 include another dovetail slot 24 formed therein for engaging with the dovetails 44, 54 of the weight members 40 and the weight elements 50 respectively, and for allowing the weight members 40, 41 and the weight elements 50, 51 to be attached or coupled to the longitudinal bars 20, 21 respectively. The weight members 40, 41 and the weight elements 50, 51 may also be attached or coupled to the longitudinal bars 20, 21 with spring biased latches or catches or locks 25 (FIGS. 13-14) which may attached or coupled the selective number of the weight members 40, 41 and the weight elements 50, 51 to the longitudinal bars 20, 21 respectively.

Figure 3:
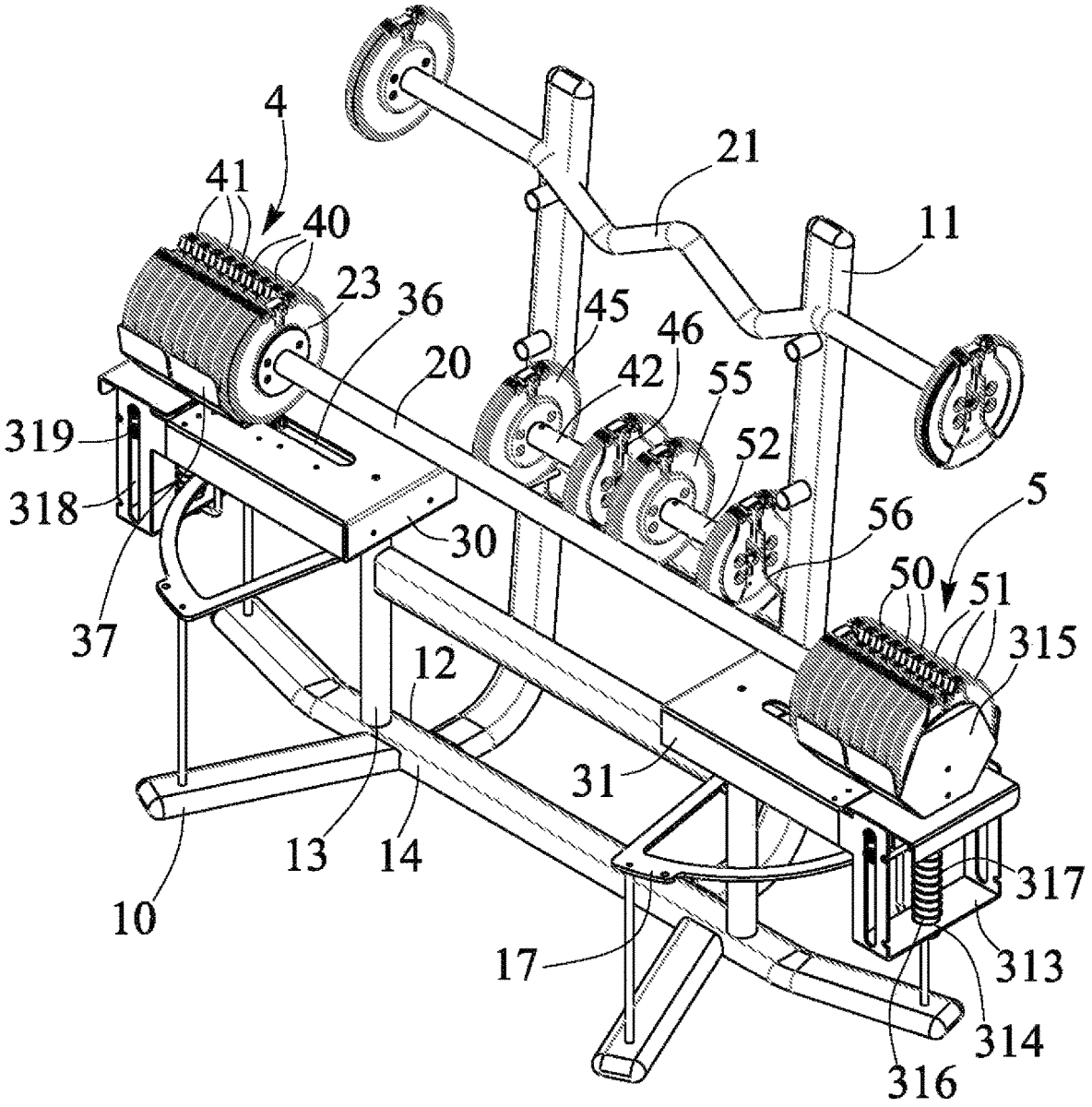
FIG. 3 is a further upper perspective view similar to FIG. 1, illustrating the operation of the dumbbell and barbell supporting system.
Figure 4:
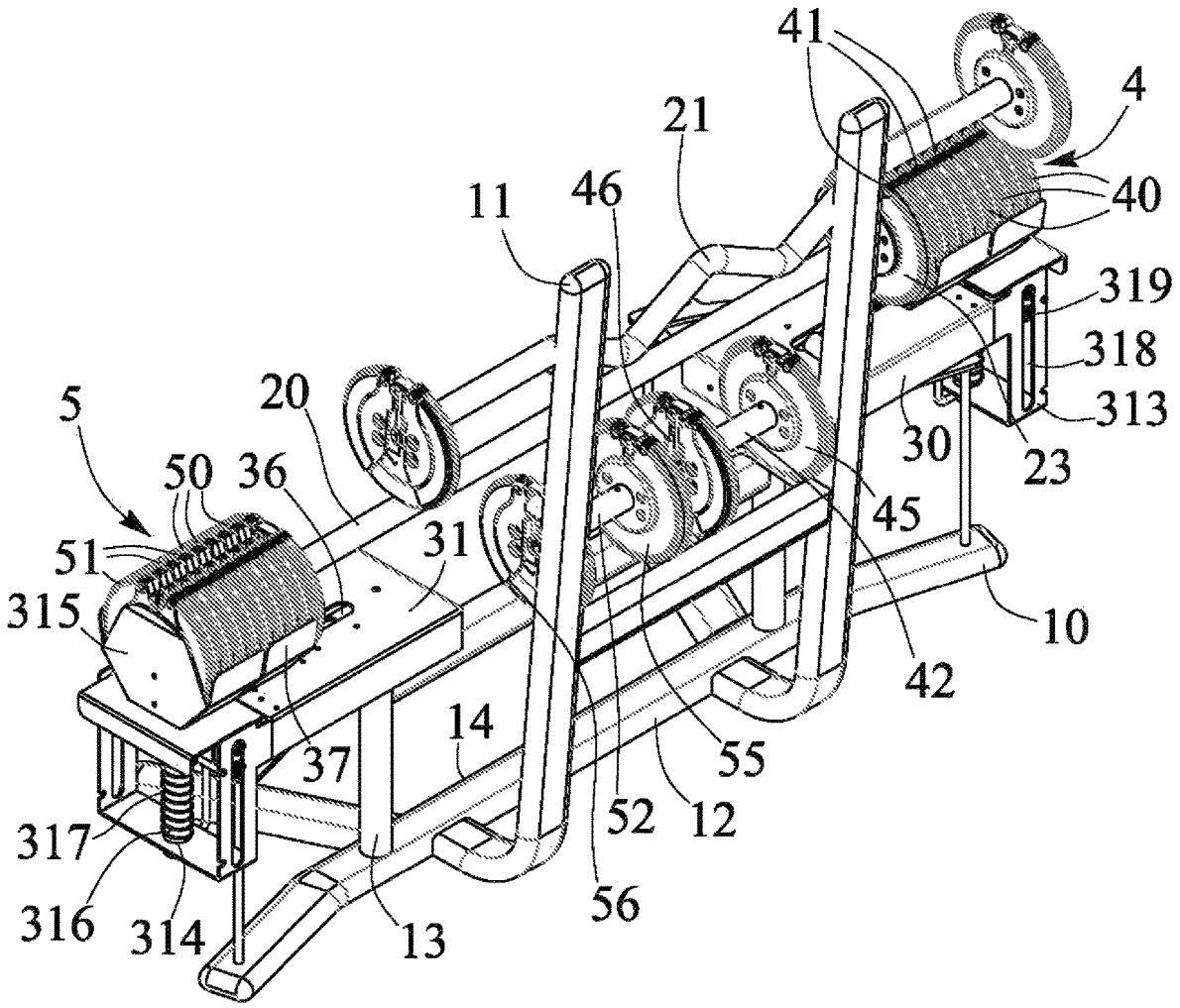
FIG. 4 is a still further upper perspective view as seen from the rear portion of the dumbbell and barbell supporting system as shown in FIG. 3.
Figure 5:
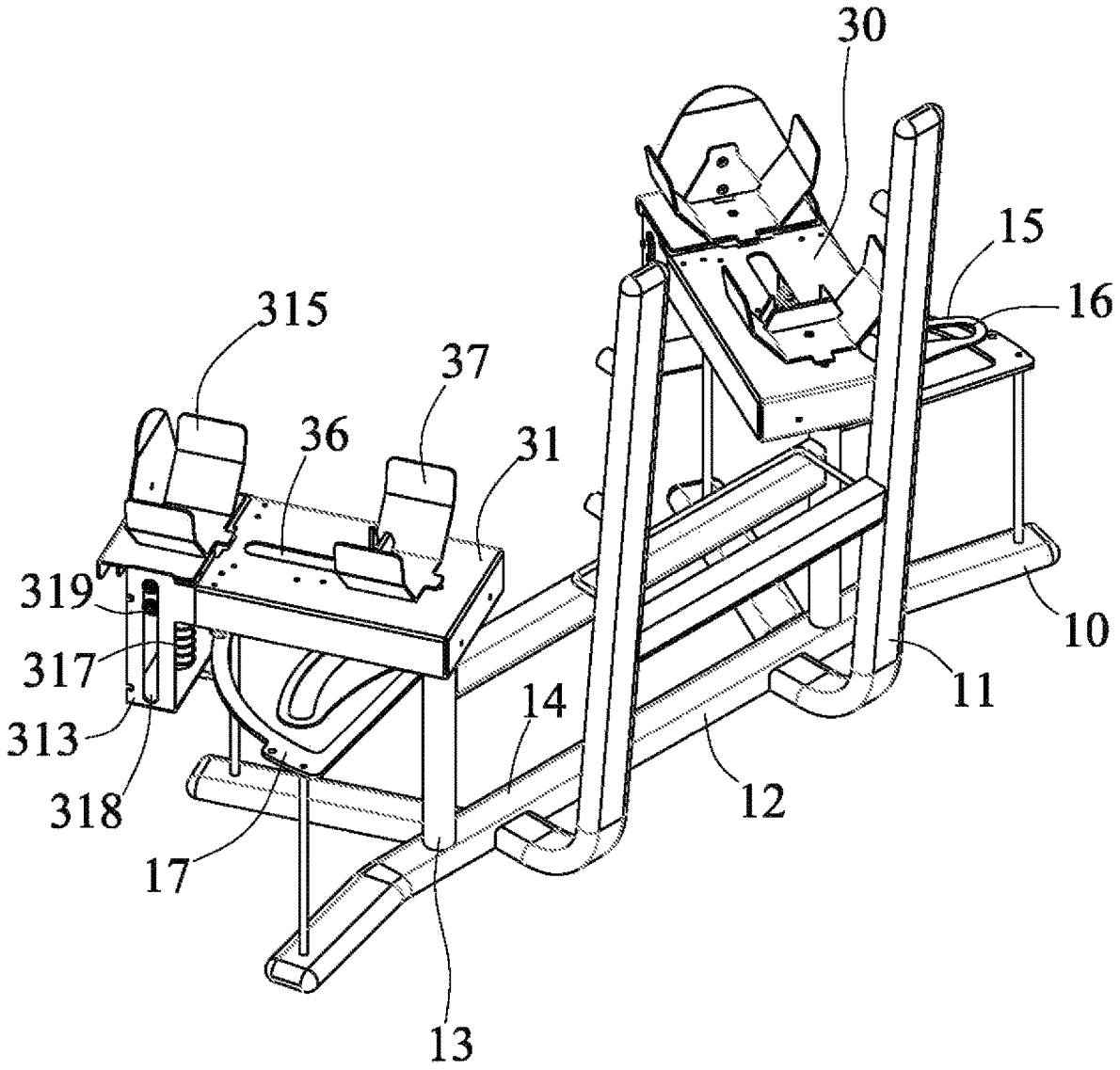
FIG. 5 is a still further upper perspective view similar to FIG. 2, with the dumbbell devices removed.

In operation, as shown in FIGS. 1-2, the dumbbells 4, 5 and the tables 30, 31 are tilted or inclined relative to each other and arranged for allowing the handlebars 42, 52 of the dumbbells 4, 5 to be easily and quickly held or grasped and actuated or operated by the users selectively in order to operate or conduct a dumbbell exercising operation. Alternatively, as shown in FIGS. 3-4 and 9, the tables 30, 31 may also be pivoted or rotated relative to the base 10 to a position where the tables 30, 31 are in line or aligned with each other, the first weight members 40 and the first weight elements 50 will then be pivoted or rotated relative to the tables 30, 31 and the second weight members 41 and the second weight elements 51 and then engaged and coupled to the second weight members 41 and the second weight elements 51 respectively, the end panels 23 of the longitudinal bars 20, 21 may then be engaged with the dovetails 44, 54 of the weight members 40 and the weight elements 50 for allowing the weight members 40, 41 and the weight elements 50, 51 to be attached or coupled to the longitudinal bars 20, 21 respectively.

Accordingly, the dumbbell and barbell supporting system in accordance with the present invention includes an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dumbbell and barbell supporting system comprising:

a base, a first table and a second table rotatably attached to said base, said first and said second tables being rotatable relative to said base to a first working position where said first and said second tables are angled relative to each other in a horizontal plane with respect to said base, and a second working position where said first and said second tables are in line with each other, a first dumbbell disposed on said first table, said first dumbbell including a first weight member and a second weight member, and a first handlebar configured to be engaged with said first weight member and said second weight member for detachably coupling said first weight member and said second weight member to said first handlebar, a second dumbbell disposed on said second table, said second dumbbell including a first weight element and a second weight element, and a second handlebar configured to be engaged with said first weight element and said second weight element for detachably coupling said first weight element and said second weight element to said second handlebar, two carriers configured to engage with and support said first weight member and said first weight element on said first and second tables, two brackets configured to engage with and support said second weight member and said second weight element on said first and second tables, said two carriers and said first weight member and said first weight element configured to be rotated and moved toward said two brackets and said second weight member and said second weight element when said two carriers, said first weight member and said first weight element are on said first and second tables, and said first and said second tables are positioned in said second working position, and a longitudinal bar configured to be engaged with said first weight member and said first weight element for detachably coupling said first weight member and said second weight member and said first weight element and said second weight element to said longitudinal bar.

2. The dumbbell and barbell supporting system as claimed in claim 1, wherein said first and said second tables each include a groove, and said two carriers each include an axle slidably engaged with said groove of said first or said second table and for guiding said respective carrier to slide relative to said respective first or second table.

3. The dumbbell and barbell supporting system as claimed in claim 2, wherein said first and said second tables each include a follower, and the respective axle is attached to said follower.

4. The dumbbell and barbell supporting system as claimed in claim 3, wherein said base includes two ears, and said two ears each include a channel formed in said respective ear, and said followers of said first and said second tables each include a roller engaged with said channel of one of said two ears for guiding and moving said respective follower to slide relative to said respective first or second table.

5. The dumbbell and barbell supporting system as claimed in claim 2, wherein said first and said second tables each include a rack, and a gear is attached to each of said two carriers and meshed with said rack of said first or said second table for allowing said respective gear and said respective carrier of said two carriers to be rotated relative to said respective first or second table when said two carriers are moved relative to said first and said second tables.

6. The dumbbell and barbell supporting system as claimed in claim 1, wherein said first and said second tables each include a housing, said two brackets are slidably engaged with said housings respectively.

7. The dumbbell and barbell supporting system as claimed in claim 6, wherein said first and said second tables each include a spring biasing member engaged with said respective bracket for biasing and forcing said respective bracket to move upwardly relative to said respective housing.

8. The dumbbell and barbell supporting system as claimed in claim 6, wherein said two brackets each include a lock for engaging with said respective housing.

9. The dumbbell and barbell supporting system as claimed in claim 1, wherein said first and said second tables each include a pivot spindle engaged with said base for allowing said first and said second tables to be rotated relative to said base.

10. The dumbbell and barbell supporting system as claimed in claim 1, wherein said base includes two stands, and said first and said second tables each include a roller engaged with one of said two stands for supporting and carrying said respective first and said second tables on said base.

11. The dumbbell and barbell supporting system as claimed in claim 1, wherein said first dumbbell includes two spring biased catches slidably engaged in said first handlebar and engageable with said first and said second weight members for coupling said first and said second weight members to said first handlebar.

12. The dumbbell and barbell supporting system as claimed in claim 1, wherein said first and said second weight members each include a dovetail slot formed in one side, and a dovetail on another side, and said first handlebar includes two end plates, and each of the two end plates includes a dovetail slot for engaging with said dovetails of said first and said second weight members.

13. The dumbbell and barbell supporting system as claimed in claim 1, wherein said second dumbbell includes two spring biased catches slidably engaged in said second handlebar and engageable with said first and said second weight elements for coupling said first and said second weight elements to said second handlebar.

14. The dumbbell and barbell supporting system as claimed in claim 1, wherein said first and said second weight elements each include a dovetail slot formed in one side, and a dovetail on another side, and said second handlebar includes two end plates, and each of the two end plates includes a dovetail slot for engaging with said dovetails of said first and said second weight elements.

15. The dumbbell and barbell supporting system as claimed in claim 1, wherein said longitudinal bar includes two end panels, and each of the two end panels includes a dovetail slot for engaging with dovetails of said first weight member and said first weight element.

16. The dumbbell and barbell supporting system as claimed in claim 1, wherein said longitudinal bar includes two spring biased locks for engaging with said first and said second weight members and said first and said second weight elements.

* * * * *